United States Patent [19]

Craemer et al.

[11] 4,360,538

[45] Nov. 23, 1982

[54] GLUE MACHINE AUTOMATIC RIDER ROLL

[75] Inventors: Robert H. Craemer, Cherry Hill; Anthony N. Scardapane, Pennsauken, both of N.J.

[73] Assignee: Molins Machine Company, Inc., Cherry Hill, N.J.

[21] Appl. No.: 245,299

[22] Filed: Mar. 19, 1981

[51] Int. Cl.[3] ..... B05C 1/08; B05D 1/28

[52] U.S. Cl. ..... 427/8; 427/10; 118/671; 118/672

[58] Field of Search ..... 427/8, 10; 118/671, 118/672

[56] References Cited

U.S. PATENT DOCUMENTS 2,876,734 3/1959 Nitchie ..... 118/680 X 3,110,110 11/1963 Forrester et al. ..... 33/149

*Primary Examiner*—James R. Hoffman

*Attorney, Agent, or Firm*—Seidel, Gonda, Goldhammer & Panitch

[57] ABSTRACT

The caliper of single face corrugated paperboard is measured and a caliper signal is generated. A gap signal is generated to represent the gap between a rider roll and an applicator roll. A value is subtracted from the caliper signal or a value is added to the gap signal to represent the desired compression of the paperboard as it passes between the rider roll and the applicator roll. A comparator compares the signals after one of the signals has been modified and generates a difference signal. A motor responsive to the difference signal is provided for adjusting the rider roll so as to maintain the gap at a preselected value with respect to the caliper of the board prior to its compression.

10 Claims, 5 Drawing Figures

60
62
64
66
68
70
72
74
76
78
80
82
84
86
88
90
92
94
96
98
MOTOR
13

FIG. 4
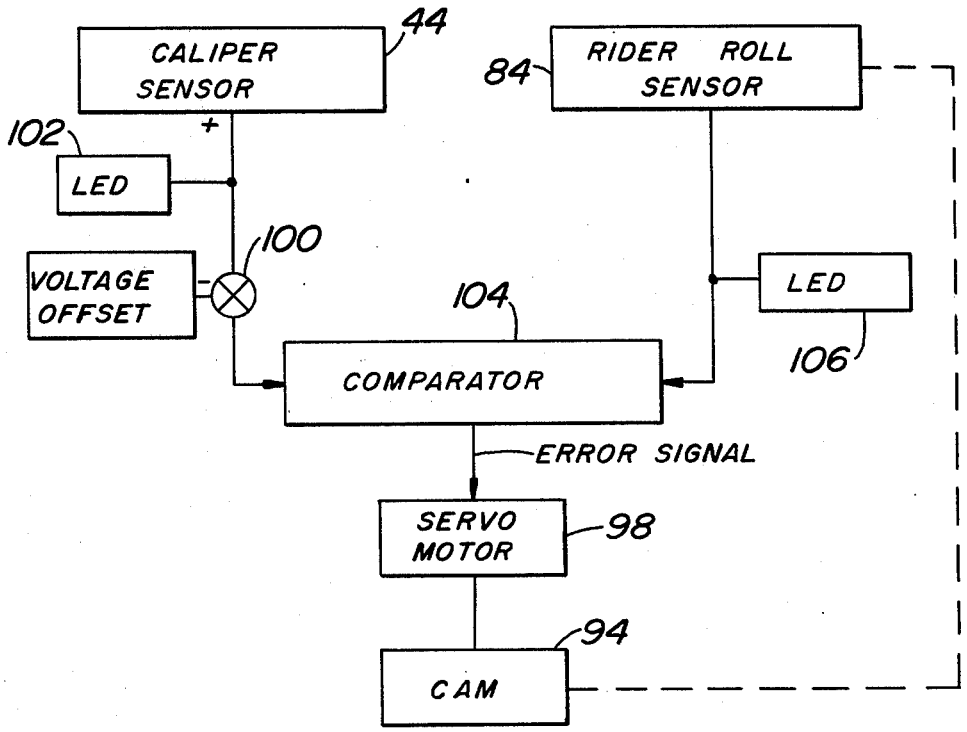
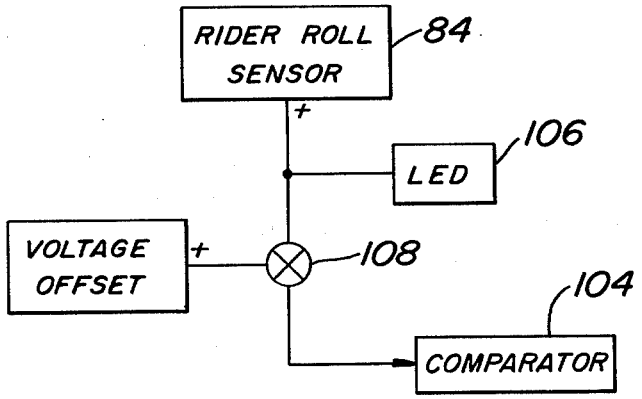
FIG. 5

GLUE MACHINE AUTOMATIC RIDER ROLL

BACKGROUND

Single face corrugated paperboard webs are made on a single facer machine. A liner is attached to the crests of the corrugations to form double face corrugated paperboard at a double facer glue machine. At the glue machine, the web passes between an adhesive applicator roll and a rider roll. The amount by which the rider roll compresses the corrugations establishes the amount of adhesive applied. Accordingly, the rider roll must be ballasted to apply either a constant predetermined pressure or to maintain a constant predetermined gap between its periphery and the adhesive applicator roll.

The effective pressure on the rider roll can be maintained either by a pressure control arrangement as described in U.S. Pat. No. 2,876,734 or by controlling the gap between the rider roll and the adhesive applicator roll. To maintain a uniform compression of the single faced paperboard as it passes between the rolls, the thickness of the web must be sensed. Thus, there is need for sensing apparatus capable of acting on the corrugated side of the web for measuring the thickness of the web as the web is moving at high speed so that appropriate adjustments and/or stopping of the web can be attained. The flexibility, the ease of deformation and the undulated nature of the corrugated side of the web complicate the problems in designing suitable sensing apparatus.

In addition to knowing the caliper of the single face web entering the glue machine to control the gap, it is necessary to position a rider roll at a preset distance or gap from the adhesive applicator roll and to have the rider roll vary this gap as the caliper of the web entering the glue machine increases or decreases. Thus, the single face flutes are always under a predetermined compression as they contact the applicator roll and consequently each flute tip picks up an equal amount of a bonding agent.

Improper compression of the single face flutes causes both wastage of bonding agent and excessive consumption of heat in the double facer. If the board is compressed too much, the caliper and strength may be too low for commercial use. Partially crushed board has reduced column strength and dimensioned compression resistance. On the other hand, insufficient application of adhesive lowers the quality of the corrugated board by reducing pin adhesion.

Accordingly there is a need for apparatus having automatic controls for applying the optimum amount of an adhesive bonding agent under changing conditions.

SUMMARY OF THE INVENTION

To overcome the deficiencies of the prior art, the present invention provides means for an operator to preset a desired amount of compression of the single face flutes between the rider roll and the adhesive applicator roll and this compression can be maintained automatically with respect to changes in the caliper of the single face board.

The present invention includes apparatus for controlling the application of a liquid bonding agent to the flute tips of a single face corrugated paperboard web at a double facer glue machine. The glue machine includes a receptacle for holding a supply of bonding agent with an applicator roll partially immersed in said supply. A means is provided for metering the amount of bonding agent on the surface of the applicator roll. A rider roll is provided for urging the single face corrugated paperboard web against the applicator roll. An idler roll is provided upstream from the glue machine for guiding the paperboard web.

A sensor means is associated with the idler roll for sensing the caliper of the single face paperboard web and for transmitting a caliper signal. A sensor means is associated with the rider roll for sensing the gap between the peripheries of the rider roll and applicator roll and for transmitting a gap signal. A means is provided for subtracting a value from the caliper signal or for adding a value to the gap signal to represent a desired compression of the paperboard web as it passes between the rider roll and applicator roll. A comparator means is provided for comparing the signals after one of the signals has been modified and for generating a difference signal. A motor is provided and is responsive to the difference signal, if any, for moving the rider roll so as to control the gap to maintain the compression of the flutes at the preselected value.

A primary object of the invention is to provide apparatus for applying the optimum amount of bonding agent to the flute tips of single face corrugated paperboard for improving the uniformity and quality of the resultant double face board.

It is another object of the present invention to provide means for reducing heat consumption and waste in manufacture of corrugated paperboard.

It is another object of the present invention to provide apparatus and method for maintaining a uniform gap between a rider roll and an applicator roll with the ability to vary the gap automatically to compensate for any changes in the caliper of single face paperboard fed into the gap.

Other objects and advantages will become apparent hereinafter.

For the purpose of illustrating the invention, there is shown in the drawings a form which is presently preferred; it being understood, however, that this invention is not limited to the precise arrangements and instrumentalities shown.

FIG. 4 is a block diagram showing the interrelationship of the structure shown in FIGS. 1 and 3.

FIG. 5 is a block diagram showing the relationship when adding the offset voltage to the rider roll sensor signal.

DETAILED DESCRIPTION

Figure 1:
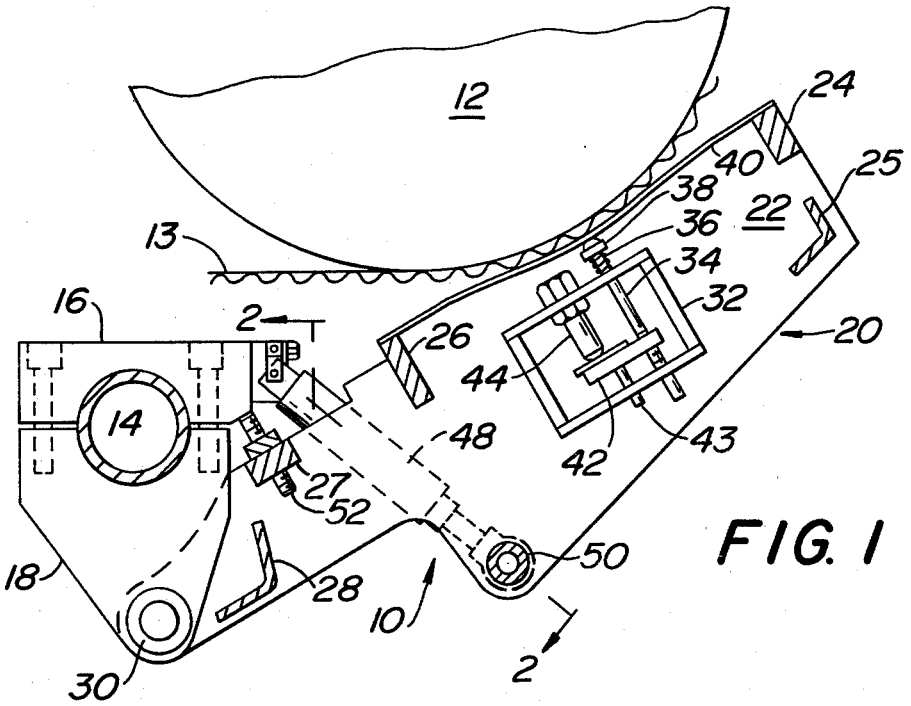
FIG. 1 is a sectional view of an idler roll and caliper sensor.

Referring to the drawings in detail, wherein like numerals indicate like elements, there is shown in FIG. 1 a sensor apparatus designated generally as 10 for sensing the caliper of a web of single face paperboard 13 juxtaposed to an idler roll such as a preheater drum 12. The drum 12 is mounted on the upstream side of the glue machine to guide and heat the single face web 13 as it enters the glue machine. The drum 12 has a smooth outer peripheral surface and is preferably hollow so that it may be heated by passing steam therethrough. The sensor apparatus 10 is supported in any convenient manner adjacent to the preheater drum 12.

For purposes of illustration, the support structure for the sensor apparatus 10 is a pipe 14 which extends parallel to the drum 12 and is supported at its ends in any convenient manner so as to be transverse to the direction of movement of the web 13. A pair of mating collars 16, 18 are adjustably clamped to the pipe 14 to facilitate installation, maintenance and adjustment of the sensor apparatus 10 along the length of pipe 14. Preferably, the apparatus 10 is positioned along a side edge portion of the web 13 to permit the machine operator to manually disengage the apparatus 10 when starting a new web or when idling the machine.

The apparatus 10 includes a frame 20 pivotably connected to collar 18. Frame 20 includes parallel side frame members 22, 23 rigidly interconnected by transverse struts 24–28. The frame 20 is pivotably connected to collar 18 by way of pin 30 whose axis is horizontally disposed.

A sensor support 32 is positioned transversely of the frame 20 and comprises a box-like structure having four sides. The sensor support 32 provides guidance for an actuating pin 34 whose longitudinal axis is radially disposed with respect to the drum 12. A spring 36 surrounds a portion of the pin 34 and extends between support 32 and a collar 38 on the pin 34. Spring 36 biases the head on pin 34 into contact with one side face of a flexible contact member 40 made from a material such as spring steel. The other face of member 40 is in contact with the flute tips on the web 13. The end of pin 34 remote from the collar 38 is threaded. A sensing member 42 is coupled to the pin 34 by way of said threads thereon and is guided with respect to the support 32 by way of guide pin 43 which is parallel to pin 34. Member 42 is spaced from a sensor 44 and moves toward and away from sensor 44 in response to the caliper of the web 13. Sensor 44 is preferably a proximity sensor which is commercially available and generates a signal as a function of the width of the gap between member 42 and the adjacent end of sensor 44. Such signal is considered a caliper signal since it represents the thickness of the single faced web 13.

Figure 2:
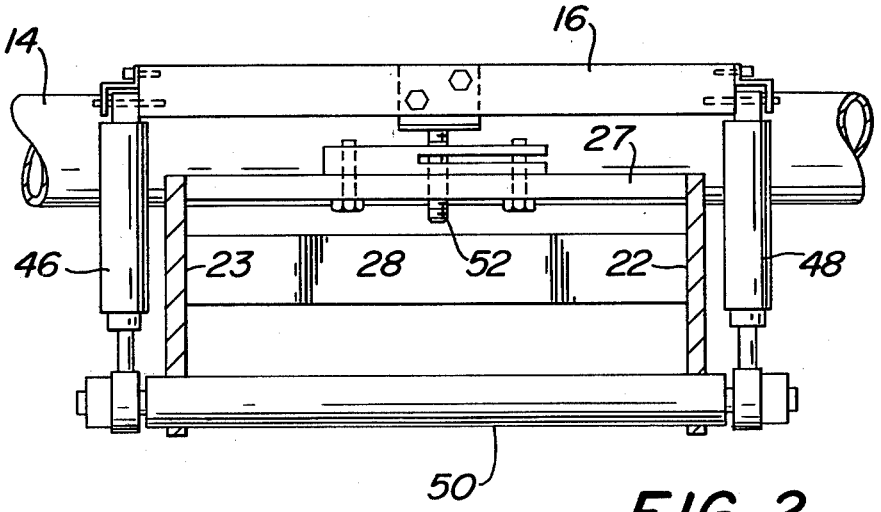
FIG. 2 is a sectional view taken along the line 2—2 in FIG. 1.

A pair of air springs 46, 48 provided for adjusting the frame 20 toward and away from the drum 12. The upper ends of the air springs 46, 48 are pivotably connected to the collar 16. The lower ends of the air springs 46, 48 are pivotably connected to a hollow shaft 50 which extends transversely between the side frame members 22, 23. See FIG. 2. The extent to which frame 20 may pivot toward the periphery of drum 12 is limited by the adjustable limit stop 52 which cooperates with the collar 16. Limit stop 52 prevents wear of the contact member 40 when no web 13 is present.

Figure 3:
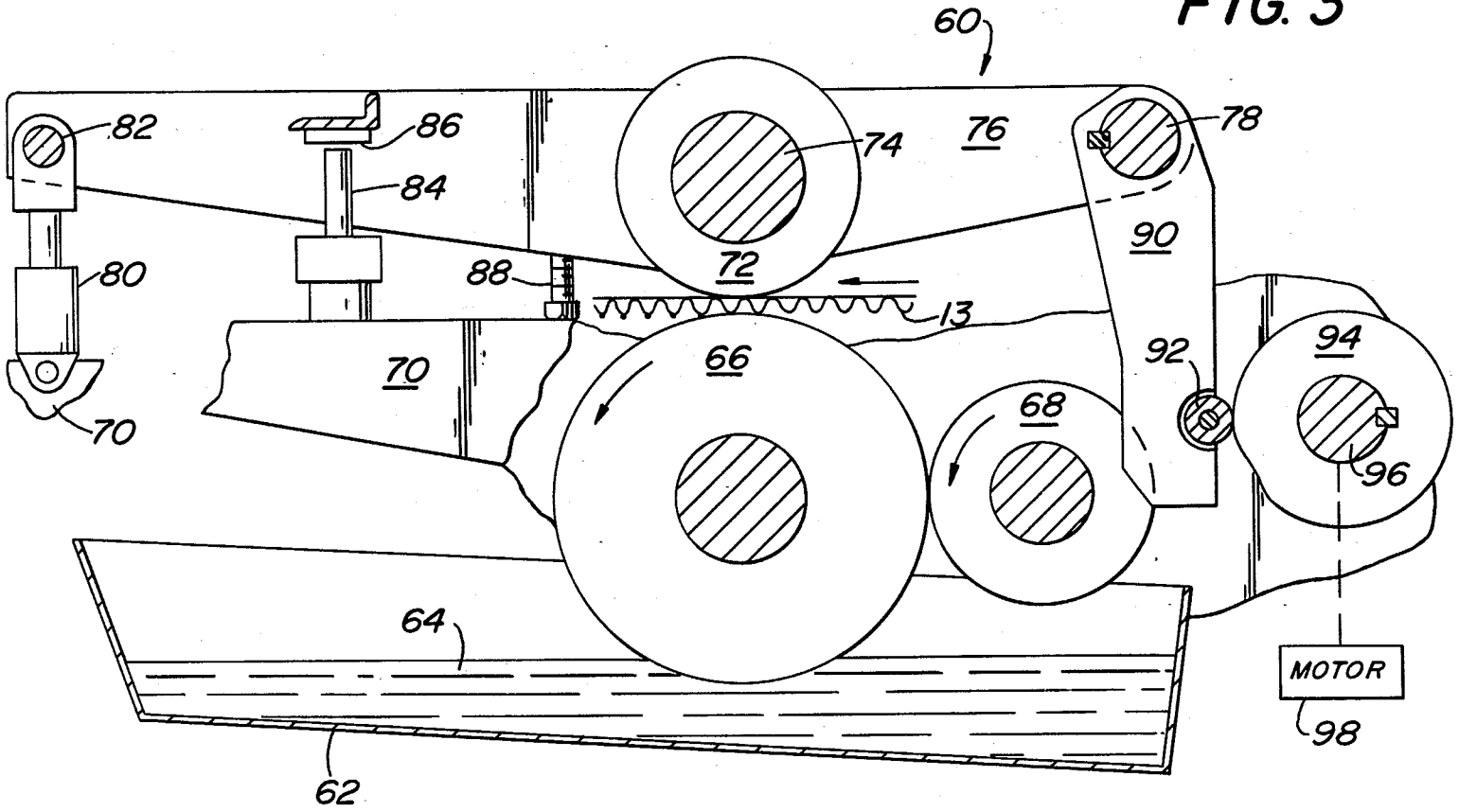
FIG. 3 is a sectional view through a rider roll mechanism.

Referring to FIG. 3, there is shown a portion of a glue machine 60 which includes a conventional pan 62 within which is disposed a bonding agent 64 such as a starch adhesive. An applicator roll 66 is partially immersed in the bonding agent 64. The surface of the applicator roll 66 may be roughened as by sand-blasting or may be embossed with cells to retain the bonding agent on its periphery. A doctor roll 68 is provided for controlling the amount of adhesive on the surface of applicator roll 66.

The rolls 66, 68 are supported by a frame designated 70. A rider roll 72 is provided above the applicator roll 66 so that there is a gap between their peripheries. Rider roll 72 is mounted on a shaft 74. Shaft 74 extends between a pair of levers 76. One end of each lever is fixedly connected to a shaft 78. Only one of the levers 76 is shown. The other end of the levers 76 is pivotably connected to a discrete pneumatic cylinder 80 by way of pivot pin 82. Cylinders 80 are pivotally connected to the frame 70. If web 13 is not present at drum 12, the caliper signal from sensor 44 will be above a predetermined value whereby cylinders 80 will be operated to move rider roll 72 upwardly and lock the same in an inoperative position.

The lever 76 shown in FIG. 3 is provided with a sensing member 86 which may be a portion of a structural angle. A sensor 84 is supported by the frame 70. Sensor 84 may be a proximity sensor which is commercially available and which generates a signal as a function of the width of the gap between it and member 86. Lever 76 is provided with an adjustable limit stop 88 adapted to contact the frame 70 and thereby define the minimum dimension for the gap between the peripheries of rider roll 72 and applicator roll 66.

A crank arm 90 is fixedly connected to the lever 76 by way of the shaft 78. Adjacent its free end, the arm 90 rotatably supports a cam follower 92. Cam follower 92 is in contact with the periphery of the cam 94 on shaft 96. Shaft 96 is connected to a servomotor 98.

Referring to FIG. 4, the sensor 44 generates a signal representative of the caliper of the web 13. The caliper signal is displayed on a monitor 102 and is tranmitted through a summing junction 100 to a comparator 104. In the summing junction 100, the signal is modified by a value representative of the desired compression of the flutes as the web 13 passes through the gap between the peripheries of the rider roll 72 and the applicator roll 66. Where the caliper signal is a positive voltage from one to ten volts, summing junction 100 may be a negative voltage offset so as to cause a flute tip crush in an amount such as 0.010 inch.

The sensor 84 generates a gap signal which is displayed on a monitor 106 and transmitted to the comparator 104. The comparator 104 compares the respective signals after the caliper signal has been modified and generates a difference signal which is transmitted to the servomotor 98. Motor 98 is a reversible motor for rotating the cam 94 to thereby reposition the elevation of the rider roll 72 and change the gap for the web 13 until the signals fed to the comparator 104 are balanced.

In the above preferred embodiment, the caliper signal was modified by applying a negative voltage at junction 100 to reduce the signal by a value representative of the desired compression of the flutes of web 13. The same result can be accomplished by adding a similar voltage to the gap signal generated by sensor 84. See FIG. 5 wherein the gap signal is displayed on monitor 106 and is transmitted through junction 108 to comparator 104. In the summing junction 108, the signal is modified by addition of a positive voltage to the signal generated by sensor 84.

The monitors 102, 106 may be of the light emitting diode type. The voltage offset to junctions 100, 108 may be selectively adjusted by using decade digital thumbwheel switches or continuous analog potentiometers on an instrument panel.

As will be made clear hereinafter, the control attained by the present invention may be automatic or manual. In each mode, the signals are displayed on the monitors 102, 106 of the instrument panel. In the automatic mode, the comparator 104 generates a difference signal which drives the servomotor 98 which in turn moves the cam 94 which in turn repositions the rider roll 72 to vary the gap. The rider roll 72 rides on the web 13 and, due to the size of the gap, causes the web to be subjected to a predetermined amount of compression whereby each flute will have the same amount of adhesive applied thereto by applicator roll 66.

In the manual mode, the comparator 104 is disconnected and the operator adjusts the crush on the basis of the readings shown on the monitors 102, 106. To facilitate such manual adjustment of the gap, the instrument panel has a selector switch to cut out comparator 104 and pushbuttons for manually controlling the gap to couple electricity to the servomotor 98 which in turn rotates cam 94 until the readings displayed on the monitors 102, 106 reach desired values.

Thus, it will be noted that the present invention generates a signal representative of the caliper of the web 13 and generates a signal representative of the gap between the peripheries of the rider roll 72 and the applicator roll 66 so that a predetermined compression may be applied to the web 13. As the caliper of the web changes, the size of the gap will correspondingly change automatically or may be changed manually.

The present invention may be embodied in other specific forms without departing from the spirit or essential attributes thereof and, accordingly, reference should be made to the appended claims, rather than to the foregoing specification.

We claim:

1. Apparatus for controlling the application of a liquid bonding agent to the flute tips of a web of single face corrugated paperboard at a double facer glue machine which includes a receptacle for holding a supply of the bonding agent, an applicator roll partially immersed in said supply, a rider roll for urging the web against the applicator roll as the web moves therebetween, means supporting the rider roll for movement toward and away from the applicator roll to vary the gap therebetween, and an idler roll upstream from said rider roll for guiding the web, the improvement comprising:

(a) means associated with the idler roll for sensing, generating and transmitting a caliper signal as a function of said caliper of the web, (b) means associated with the rider roll for sensing, generating and transmitting a gap signal as a function of the gap between the rider roll and the applicator roll, (c) means for modifying one of said caliper signal and gap signal by subtracting a value from the caliper signal or adding a value to the gap signal to represent the desired compression of the web as it passes between said rider roll and said applicator roll, (d) a comparator for generating a difference signal signal after one of said signals has been modified, a motor responsive to said difference signal, and means controlled by said motor for adjusting said gap.

2. Apparatus in accordance with claim 1 including a cam, a cam follower in contact with said cam, an arm supporting said cam follower, said arm being connected to a support for said applicator roll.

3. Apparatus in accordance with claim 1 wherein each sensor means is a proximity sensor.

4. Apparatus for controlling the application of a liquid bonding agent to the flute tips of a web of single face corrugated paperboard at a double facer glue machine which includes a receptacle for holding a supply of the bonding agent, an applicator roll partially immersed in said supply, a rider roll for urging the web against the applicator roll as the web moves therebetween, means supporting the rider roll for movement toward and away from the applicator roll to vary the gap therebetween, and an idler roll upstream from said rider roll for guiding the web, the improvement comprising:

(a) sensor means associated with the idler roll for sensing the caliper of the web and for transmitting a caliper signal, (b) sensor means associated with the rider roll for sensing the gap between the rider roll and the applicator roll and for transmitting a gap signal, (c) means for modifying one of said caliper signal and gap signal by subtracting a value from the caliper signal or adding a value to the gap signal to represent the desired compression of the web as it passes between said rider roll and applicator roll, and (d) means for exhibiting and comparing said signals after one of said signals has been modified and for automatically generating a difference signal, a servomotor responsive to said difference signal, and means controlled by said servomotor for moving said rider roll for maintaining said gap below the caliper of the web to thereby partially crush the web as it passes through said gap.

5. Apparatus in accordance with claim 4 wherein said rider roll support means comprises a pivotably mounted lever, said rider roll being supported by said lever between its ends, a cylinder connected to said lever for pivoting said lever about one end, said last mentioned means including a crank arm connected to said one end of said lever, a cam follower supported by said crank arm, and a cam in contact with said cam follower.

6. A method of controlling the application of a bonding agent to flute tips of a web of single face corrugated paperboard in a glue machine as the web passes through a gap between the peripheries of a rider roll and an applicator roll comprising the steps of:

(a) sensing the caliper of the web upstream from said glue machine and generating and transmitting a caliper signal as a function of said caliper of the web, (b) sensing the gap and generating and transmitting a gap signal as a function of said gap, (c) modifying one of said signals by an amount corresponding to a desired compression of the web as it passes through said gap, comparing said signals after one of said signals has been thusly modified, generating a difference signal, and (d) adjusting said gap in response to said difference signal.

7. A method in accordance with claim 6 including locking said rider roller in an inoperative position when said caliper signal is less than a normal value and thereby indicates the absence of a web in contact with said idler roll.

8. A method in accordance with claim 6 including the step of automatically generating a difference signal, and driving a servomotor by said difference signal to adjust said gap.

9. A method in accordance with claim 6 wherein said step of modifying one of said signals includes subtracting a predetermined voltage from the caliper signal.

10. Apparatus in accordance with claim 1 wherein said gap adjusting means includes a cam connected to a motor for rotation therewith, a cam follower in contact with said cam, an arm for urging said cam follower towards said cam, lever means connected to said arm and supporting said rider roll adjacent said applicator roll, whereby movement of said lever means varies the gap between said applicator roll and said idler roll.

* * * * *